US009938776B1

(12) United States Patent
Castillo et al.

(10) Patent No.: US 9,938,776 B1
(45) **Date of Patent: *Apr. 10, 2018**

(54) POLYCRYSTALLINE DIAMOND COMPACT INCLUDING A SUBSTRATE HAVING A CONVEXLY-CURVED INTERFACIAL SURFACE BONDED TO A POLYCRYSTALLINE DIAMOND TABLE, AND RELATED APPLICATIONS

(71) Applicant: US SYNTHETIC CORPORATION, Orem, UT (US)

(72) Inventors: Alberto Castillo, Orem, UT (US); Jedediah Chad Clarke, Springville, UT (US); Brandon Paul Linford, Draper, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 107 days.

This patent is subject to a terminal disclaimer.

(21) Appl. No.: 15/050,105

(22) Filed: Feb. 22, 2016

Related U.S. Application Data

(63) Continuation of application No. 13/863,465, filed on Apr. 16, 2013, now Pat. No. 9,297,212, which is a (Continued)

(51) Int. Cl.
*E21B 10/46* (2006.01)
*E21B 10/55* (2006.01)
(Continued)

(52) U.S. Cl.
CPC ..... *E21B 10/5735* (2013.01); *B24D 3/06* (2013.01); *B24D 18/0009* (2013.01); *E21B 10/55* (2013.01); *E21B 2010/545* (2013.01)

(58) Field of Classification Search
CPC .... E21B 2010/425; E21B 10/46; E21B 10/55; E21B 2010/561; E21B 2010/565;
(Continued)

(56) References Cited

U.S. PATENT DOCUMENTS 3,149,411 A 12/1962 Smiley et al.
3,293,012 A 12/1966 Smiley et al.
(Continued)

FOREIGN PATENT DOCUMENTS

WO WO 2012/009285 1/2012

OTHER PUBLICATIONS

U.S. Appl. No. 14/313,715, Feb. 9, 2017, Final Office Action.
(Continued)

*Primary Examiner* — Cathleen R Hutchins
(74) *Attorney, Agent, or Firm* — Dorsey & Whitney LLP

(57) ABSTRACT

Embodiments of the invention relate to polycrystalline diamond compacts including a substrate having a convexly-curved interfacial surface bonded to a polycrystalline diamond table. In an embodiment, a polycrystalline diamond compact includes a substrate including at least one side surface and a convexly-curved interfacial surface that may, in some embodiments, extend inwardly directly from the at least one side surface to form at least one peripheral edge therebetween. The polycrystalline diamond compact further includes a polycrystalline diamond table bonded to the convexly-curved interfacial surface of the substrate.

16 Claims, 9 Drawing Sheets

Related U.S. Application Data continuation-in-part of application No. 13/795,027, filed on Mar. 12, 2013.

(51) Int. Cl.

| | |
|---|---|
| ***E21B 10/573*** | (2006.01) |
| ***B24D 3/06*** | (2006.01) |
| ***B24D 18/00*** | (2006.01) |
| *E21B 10/54* | (2006.01) |

(58) Field of Classification Search

CPC .. E21B 10/567; E21B 10/573; E21B 10/5735; E21B 2010/562; E21B 10/5673; E21B 2010/622; E21B 10/627; E21B 10/633

See application file for complete search history.

(56) References Cited

U.S. PATENT DOCUMENTS

| | | | |
|---|---|---|---|
| 3,372,010 | A | 3/1968 | Parsons |
| 4,018,576 | A | 4/1977 | Lowder et al. |
| 4,171,339 | A | 10/1979 | Lee |
| 4,268,276 | A | 5/1981 | Bovenkerk |
| 4,274,900 | A | 6/1981 | Mueller |
| 4,410,054 | A | 10/1983 | Nagel et al. |
| 4,468,138 | A | 8/1984 | Nagel |
| 4,534,773 | A | 8/1985 | Phaal et al. |
| 4,560,014 | A | 12/1985 | Geczy |
| 4,738,322 | A | 4/1988 | Hall et al. |
| 4,811,801 | A | 3/1989 | Salesky et al. |
| 4,871,377 | A | 10/1989 | Frushour |
| 4,907,377 | A | 3/1990 | Csillag et al. |
| 4,913,247 | A | 4/1990 | Jones |
| 5,016,718 | A | 5/1991 | Tandberg |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 5,711,702 | A | 1/1998 | Devlin |
| 5,871,060 | A | 2/1999 | Jensen et al. |
| 6,003,623 | A | 12/1999 | Miess |
| 6,488,106 | B1 | 12/2002 | Dourfaye |
| 6,793,681 | B1 | 9/2004 | Pope et al. |
| 7,377,341 | B2 | 5/2008 | Middlemiss et al. |
| 7,552,782 | B1 | 6/2009 | Sexton et al. |
| 7,559,695 | B2 | 7/2009 | Sexton et al. |
| 7,828,088 | B2 | 11/2010 | Middlemiss et al. |
| 7,866,418 | B2 | 1/2011 | Bertagnolli et al. |
| 8,066,087 | B2 | 11/2011 | Griffo et al. |
| 8,328,891 | B2 | 12/2012 | Zhang et al. |
| 8,596,387 | B1 | 12/2013 | Sani et al. |
| 8,727,045 | B1 | 5/2014 | Mukhopadhyay |
| 9,027,675 | B1 | 5/2015 | Jones et al. |
| 2005/0211475 | A1 | 9/2005 | Mirchandani et al. |
| 2005/0230156 | A1 | 10/2005 | Belnap et al. |
| 2006/0157285 | A1* | 7/2006 | Cannon ..... E21B 10/36 175/374 |
| 2006/0266558 | A1 | 11/2006 | Middlemiss et al. |
| 2008/0101977 | A1 | 5/2008 | Eason et al. |
| 2009/0152018 | A1 | 6/2009 | Sani |
| 2010/0012389 | A1 | 1/2010 | Zhang |
| 2010/0193252 | A1 | 8/2010 | Mirchandani et al. |
| 2010/0281782 | A1 | 11/2010 | Keshavan et al. |
| 2011/0023375 | A1 | 2/2011 | Sani et al. |
| 2011/0067929 | A1 | 3/2011 | Mukhopadhyay et al. |
| 2011/0120782 | A1* | 5/2011 | Cooley ..... B24D 99/005 175/432 |
| 2011/0132667 | A1* | 6/2011 | Smallman ..... B01J 3/062 175/428 |
| 2012/0040183 | A1 | 2/2012 | Kelkar |
| 2012/0138370 | A1 | 6/2012 | Mukhopadhyay et al. |
| 2012/0261197 | A1 | 10/2012 | Miess et al. |
| 2013/0092451 | A1 | 4/2013 | Mukhopadhyay et al. |
| 2013/0092452 | A1 | 4/2013 | Mukhopadhyay et al. |
| 2014/0259962 | A1 | 9/2014 | Bao |
| 2015/0292270 | A1 | 10/2015 | Zhang et al. |
| 2015/0314054 | A1 | 11/2015 | Bulent et al. |
| 2016/0002982 | A1 | 1/2016 | Mukhopadhyay et al. |

OTHER PUBLICATIONS

U.S. Appl. No. 13/863,465, Mar. 9, 2016, Issue Notification.
U.S. Appl. No. 13/027,954, filed Feb. 15, 2011, Miess et al.
U.S. Appl. No. 13/087,775, filed Apr. 15, 2011, Miess et al.
U.S. Appl. No. 13/690,397, filed Nov. 30, 2012, Miess et al.
U.S. Appl. No. 61/768,812, filed Feb. 25, 2013, Mukhopadhyay.
U.S. Appl. No. 13/795,027, filed Mar. 12, 2013, Mukhopadhyay et al.
U.S. Appl. No. 13/863,465, filed Apr. 16, 2013, Castillo, et al.
U.S. Appl. No. 13/954,545, filed Jul. 30, 2013, Mukhopadhyay.
U.S. Appl. No. 14/313,715, filed Jun. 24, 2014, Mukhopadhyay et al.
U.S. Appl. No. 14/539,015, filed Nov. 12, 2014, Mukhopadhyay et al.
U.S. Appl. No. 62/096,315, filed Dec. 23, 2014, Heaton et al.
U.S. Appl. No. 62/187,574, filed Jul. 1, 2015, Heaton.
U.S. Appl. No. 15/005,765, filed Jan. 25, 2016, Mukhopadhyay et al.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
Hildebrand et al., "Viscosity of liquid metals: An interpretation"; Proc. Nat. Acad. Sci. USA, vol. 73, No. 4, pp. 988-989, Apr. 1976.
International Search Report and Written Opinion from International Application No. PCT/US2012/059706 dated Apr. 19, 2013.
U.S. Appl. No. 13/863,465, Jul. 28, 2015, Office Action.
U.S. Appl. No. 13/863,465, Oct. 23, 2015, Office Action.
U.S. Appl. No. 13/863,465, Nov. 17, 2015, Notice of Allowance.
U.S. Appl. No. 13/275,372, Aug. 22, 2014, Office Action.
U.S. Appl. No. 13/275,372, Jan. 28, 2015, Office Action.
U.S. Appl. No. 13/275,372, Apr. 14, 2015, Office Action.
U.S. Appl. No. 13/275,372, Jun. 24, 2015, Notice of Allowance.
U.S. Appl. No. 13/275,372, Oct. 23, 2015, Notice of Allowance.
U.S. Appl. No. 13/275,372, Feb. 10, 2016, Isssue Notification.
U.S. Appl. No. 13/648,913, Jun. 25, 2015, Office Action.
U.S. Appl. No. 13/648,913, Dec. 4, 2015, Office Action.
U.S. Appl. No. 14/857,627, Feb. 18, 2016, Office Action.
U.S. Appl. No. 15/372,766, filed Dec. 8, 2016, Mukhopadhyay, et al.
U.S. Appl. No. 13/648,913, Jul. 8, 2016, Notice of Allowance.
U.S. Appl. No. 13/648,913, Oct. 19, 2016, Issue Notification.
U.S. Appl. No. 14/313,715, Sep. 13, 2016, Non-Final Office Action.
U.S. Appl. No. 14/857,627, Sep. 6, 2016, Notice of Allowance.
U.S. Appl. No. 14/857,627, Dec. 21, 2016, Issue Notification.
U.S. Appl. No. 14/313,715, Jun. 6, 2017, Advisory Action.
U.S. Appl. No. 14/313,715, Sep. 22, 2017, Office Action.

* cited by examiner

POLYCRYSTALLINE DIAMOND COMPACT INCLUDING A SUBSTRATE HAVING A CONVEXLY-CURVED INTERFACIAL SURFACE BONDED TO A POLYCRYSTALLINE DIAMOND TABLE, AND RELATED APPLICATIONS

CROSS-REFERENCE TO RELATED APPLICATIONS

This application is a continuation of U.S. patent application Ser. No. 13/863,465 filed on 16 Apr. 2013, which is a continuation-in-part of U.S. patent application Ser. No. 13/795,027 filed on 12 Mar. 2013, the disclosure of each of the foregoing applications is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. Interstitial regions between the bonded diamond grains are occupied by the metal-solvent catalyst.

Despite the availability of a number of different PDCs, manufacturers and users of PDCs continue to seek PDCs with improved mechanical properties.

SUMMARY

Embodiments of the invention relate to PDCs including a substrate having a convexly-curved interfacial surface bonded to a PCD table. The configuration of the convexly-curved interfacial surface is currently believed to improve the impact resistance of the PDC. In an embodiment, a PDC includes a substrate including a convexly-curved interfacial surface. The PDC further includes a PCD table bonded to the convexly-curved interfacial surface of the substrate. In an embodiment, the convexly-curved interfacial surface extends inwardly directly from at least one side surface of the substrate to define at least one peripheral edge therebetween, and the PCD table defines an upper surface and exhibits a minimum thickness over the convexly-curved interfacial surface of about 0.0050 inch or more. In an embodiment, the PCD table may be a preformed PCD table or a PCD table that is integrally formed with the substrate. In an embodiment, the PCD table includes a plurality of bonded diamond grains exhibiting an average grain size of about 30 μm or less, with the PCD table exhibiting about 30 to about 80 hits to failure at about a 50% probability of failure in a 40 J repeating vertical weight drop test.

In an embodiment, a method of fabricating a PDC is disclosed. The method includes providing a substrate including at least one side surface and a convexly-curved interfacial surface extending inwardly directly from the at least one side surface to define at least one peripheral edge therebetween. A diamond volume may be provided adjacent to the convexly-curved interfacial surface of the substrate to form an assembly. For example, the diamond volume may be un-sintered diamond particles, or an at least partially PCD table including a concavely-curved interfacial surface that is curved to generally correspond with the concavely-curved interfacial surface of the at least partially leached PCD table. In such an embodiment, the method further includes mating the convexly-curved interface surface of the substrate with the concavely-curved interfacial surface of the at least partially leached PCD table to form the assembly. The method additionally includes subjecting the assembly to an HPHT process effective to at least partially infiltrate the at least leached polycrystalline diamond table with a metallic infiltrant or sinter the un-sintered diamond particles to form a PCD integrally with the substrate.

Other embodiments include applications utilizing the disclosed PDCs in various articles and apparatuses, such as rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to PDCs including a substrate having a convexly-curved interfacial surface bonded to a PCD table (e.g., a preformed PCD table or a PCD table that is integrally formed with the substrate). It is currently believed by the inventors, that, according to one theory, the geometry of the convexly-curved interfacial surface may be selected so that the resistance of the preformed PCD table to impact loads is increased compared to if the interfacial surface were substantially planar, thereby rendering the PCD table more impact resistant. The disclosed PDCs may be used in a variety of applications, such as rotary drill bits, machining equipment, and other articles and apparatuses.

Figure 1A:
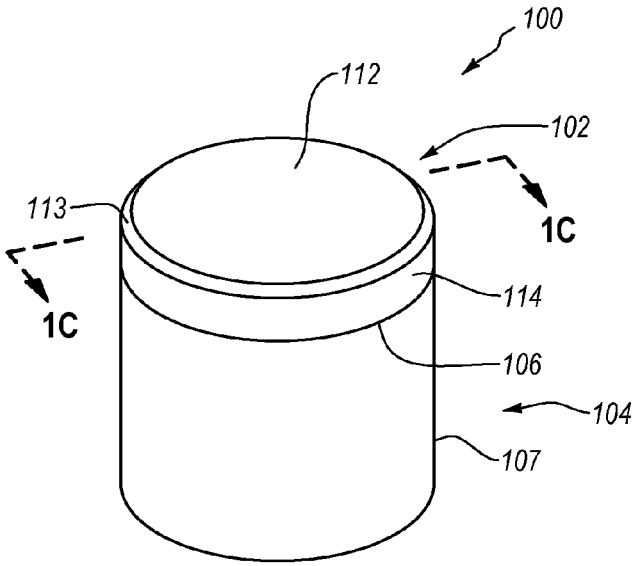
FIG. 1A is an isometric view of an embodiment of a PDC including a substrate having a convexly-curved interfacial surface bonded to a PCD table.
Figure 1B:
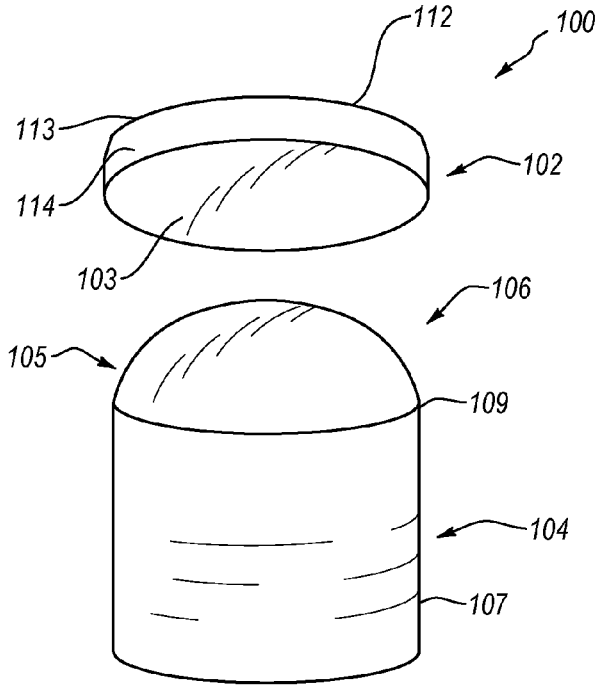
FIG. 1B is an exploded isometric view of the PDC shown in FIG. 1A.
Figure 1C:
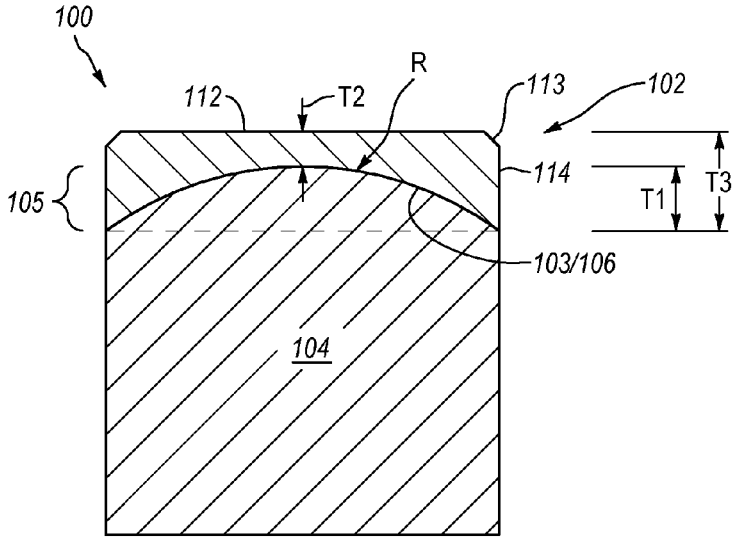
FIG. 1C is a cross-sectional view of the PDC shown in FIG. 1A taken along line 1C-1C thereof.

FIGS. 1A-1C are isometric, exploded isometric, and cross-sectional views, respectively, of an embodiment of a PDC 100. The PDC 100 includes a PCD table 102 having a concavely-curved interfacial surface 103 and a substrate 104 having a convexly-curved interfacial surface 106 that is bonded to the concavely-curved interfacial surface 103 of the PCD table 102. For example, in any of the embodiments disclosed herein, the PCD table 102 may be either a preformed PCD table that is bonded to the substrate 104 or the PCD table 102 may be integrally formed with the substrate 104. The concavely-curved interfacial surface 103 of the PCD table 102 is curved to substantially correspond to the convexly-curved interfacial surface 106 of the substrate 104. It is currently believed by the inventors, that, according to one theory, the geometry of the convexly-curved interfacial surface 106 may be selected so that the resistance of the PCD table 102 to impact loads is increased compared to if the interfacial surface were substantially planar, thereby rendering the preformed PCD table 102 more impact resistant.

The substrate 104 further includes at least one side surface 107, with the convexly-curved interfacial surface 106 extending inwardly directly from the at least one side surface 107 to define at least one peripheral edge 109 therebetween. Thus, in the illustrated embodiment, the convexly-curved interfacial surface 106 is convexly curved over substantially all of the interfacial surface of the substrate 104. In other embodiments, the convexly-curved interfacial surface 106 may form over 30% of the surface area of the interfacial surface, the convexly-curved interfacial surface 106 may form over 50% of the surface area of the interfacial surface, or the convexly-curved interfacial surface 106 may form over 75% of the surface area of the interfacial surface. The substrate 104 may comprise, for example, a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys thereof. In an embodiment, the cemented carbide substrate may comprise a cobalt-cemented tungsten carbide substrate.

Referring specifically to FIGS. 1B and 1C, the convexly-curved interfacial surface 106 of the substrate 104 is part of a domed region 105 of the substrate 104 and defines a generally elliptical surface, such as a hemispherical surface or other elliptical geometry. For example, the domed region 105 may be a truncated hemispherical body in which a thickness "T1" thereof is less than a radius "R" thereof. The radius "R" of the convexly-curved interfacial surface 106 of the substrate 104 may be about 0.500 inch to about 1.60 inch, such as about 0.650 inch to about 1.60 inch, about 0.500 inch to about 1.20 inch, about 0.60 inch to about 1.0 inch, about 0.90 inch to about 1.10 inch, about 1.00 inch, about 0.700 inch to about 0.900 inch, about 0.750 inch to about 0.800 inch (e.g., about 0.783 inch). The thickness "T1" of the domed region 105 may be about 0.0300 inch to about 0.100 inch, such as about 0.065 inch to about 0.085 inch, or about 0.040 inch to about 0.060 inch, or about 0.050 inch. A minimum thickness "T2" of the preformed PCD table 102 above an upper most location of the domed region 105 may be generally centrally located on the convexly-curved interfacial surface 106. For example, the minimum thickness "T2" may be about 0.0050 inch to about 0.100 inch, such as about 0.010 inch to about 0.100 inch, greater than about 0.040 inch, greater than about 0.050 inch, greater than about 0.060 inch, about 0.010 inch to about 0.050 inch, about 0.030 inch to about 0.050 inch, or about 0.040 inch. A maximum thickness "T3" of the preformed PCD table 102 may be about 0.050 inch to about 0.150 inch, such as about 0.075 inch to about 0.090 inch, or about 0.0900 inch to about 0.125 inch. The maximum thickness T3 of the preformed PCD table 102 is located immediately adjacent to the at least one peripheral edge 109 of the substrate 104 as measured from a working upper surface 112 of the preformed PCD table 102. When the PDC 100 is generally cylindrical, the substrate 104 may exhibit a diameter "D" of about 0.500 inch to about 1.00 inch, such as about 0.575 inch to about 0.650 inch. Any physically permissible combination of the values for R, T1, T2, T3, and D may be employed in a number of different embodiments.

The PCD table 102 includes a plurality of directly bonded-together diamond grains exhibiting diamond-to-diamond bonding (e.g., $sp^3$ bonding) therebetween. The plurality of directly bonded-together diamond grains define a plurality of interstitial regions. For example, the diamond grains may exhibit an average grain size of less than about 40 μm, such as about less than 30 μm, about 18 μm to about 30 μm, or about 18 μm to about 25 μm (e.g., about 19 μm to about 21 μm). At least a portion of the interstitial regions include a metallic constituent (e.g., a metallic infiltrant or a metallic catalyst) disposed therein. For example, the metallic constituent may be infiltrated from the substrate 104 or other source(s) during HPHT processing and occupies at least a portion of the interstitial regions of the PCD table 102. For example, the metallic constituent may be cobalt, iron, nickel, or alloys thereof, such as cobalt from a cobalt-cemented tungsten carbide substrate. The PCD table 102 defines the working upper surface 112, at least one side surface 114, and an optional peripherally-extending chamfer 113 that extends between the at least one side surface 114 and the working upper surface 112. In an embodiment, the PCD table 102 may be preformed and formed from an at least partially leached PCD table that is bonded to the substrate 104 in an HPHT process by infiltration of an infiltrant therein from the substrate 104 or one or more other sources. In another embodiment, the PCD table 102 may be integrally formed with the substrate 104 by HPHT sintering diamond particles on the convexly-curved interfacial surface 106 of the substrate 104. In fact, in any of the embodiments disclosed herein, the PCD table may be either a preformed PCD table that is bonded to a substrate in another bonding process or a PCD table that is integrally formed with the substrate.

The increased damage tolerance of the PCD table 102 may be determined by an impact test, such as a vertical weight drop test which may also be referred to herein as a repeating impact test. To evaluate the impact resistance, a weight may be vertically dropped on a sharp, non-chamfered edge of the PCD table 102 to impact the edge with, for example, 40 J of energy. The tested PDC 100 may be oriented at about a 15 degree back rake angle. The test is repeated until the tested PDC 100 fails. The PDC 100 is considered to have failed when about 30% of the PCD table 102 has spalled and/or fractured. The weight may be a flat circular plate made from a sufficiently hard material, such as a heat treated tool steel (e.g., an S7 tool steel). The weight may be rotated after each impact to ensure that a fresh undamaged portion of the weight is used for the next impact against the PCD table 102.

Any of the PDC embodiments disclosed herein, such as the PDC 100, the PCD table may exhibit at about a 50% probability of failure, about 30 to about 80 hits to failure, such as about 50 to about 70 hits to failure, about 55 to about 65 hits to failure, about 45 to about 55 hits to failure, or about 47 to about 53 hits to failure (e.g., about 50 hits to failure). Such high impact resistance may be exhibited even when the diamond grains of the PCD table 102 have a relatively fine average grain size, such as about less than 30 μm, about 18 μm to about 30 μm, or about 18 μm to about 25 μm (e.g., about 19 μm to about 21 μm).

Figure 2:
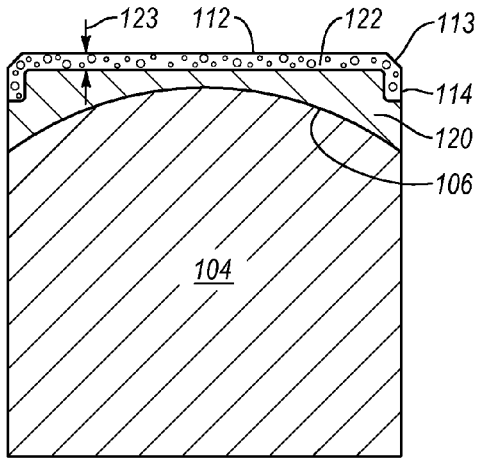
FIG. 2 is a cross-sectional view of another embodiment in which the PCD table shown in FIGS. 1A-1C is leached to deplete metallic infiltrant from a leached region thereof.

Referring specifically to the cross-sectional view of FIG. 2, in an embodiment, the PCD table 102 may be leached to improve the thermal stability thereof. The PCD table 102 includes a first region 120 adjacent to the convexly-curved interfacial surface 106 of the substrate 104. The metallic constituent provided from the substrate 104 or other source (s) during HPHT processing occupies at least a portion of the interstitial regions of the first region 120 of the PCD table 102. For example, the metallic constituent may be cobalt from a cobalt-cemented tungsten carbide substrate that infiltrated into the first region 120. The PCD table 102 also includes a leached second region 122 remote from the substrate 104 that includes the upper surface 112, the chamfer 113, and a portion of the at least one side surface 114. The leached second region 122 extends inwardly to a selected depth or depths from the upper surface 112, the chamfer 113, and a portion of the at least one side surface 114.

The leached second region 122 has been leached to deplete the metallic constituent therefrom that used to occupy the interstitial regions between the bonded diamond grains of the leached second region 122. The leaching may be performed in a suitable acid (e.g., aqua regia, nitric acid, hydrofluoric acid, or combinations thereof) so that the leached second region 122 is substantially free of the metal-solvent catalyst. As a result of the metallic constituent being depleted from the leached second region 122, the leached second region 122 is relatively more thermally stable than the underlying first region 120.

Generally, a maximum leach depth 123 may be greater than 250 μm. For example, the maximum leach depth 123 for the leached second region 122 may be about 300 μm to about 425 μm, about 250 μm to about 400 μm, about 350 μm to about 400 μm, about 350 μm to about 375 μm, about 375 μm to about 400 μm, about 500 μm to about 650 μm, about 600 μm to about 1100 μm, or about 750 μm to about 1000 μm. The maximum leach depth 123 may be measured inwardly from at least one of the upper surface 112, the chamfer 113, or the at least one side surface 114.

The PCD table 102 exhibits a non-uniform thickness over the convexly-curved interfacial surface 106. In the illustrated embodiment, the minimum thickness T2 of the PCD table 102 is located immediately over the upper most location of the convexly-curved interfacial surface 106 as measured from the upper surface 112. According to various embodiments, a ratio of the maximum leach depth 123 to the thickness T2 of the preformed PCD table 102 may be about 0.25 to about 55, such as about 0.30 to about 0.50, or about 0.75 to about 2.

Figure 3A:
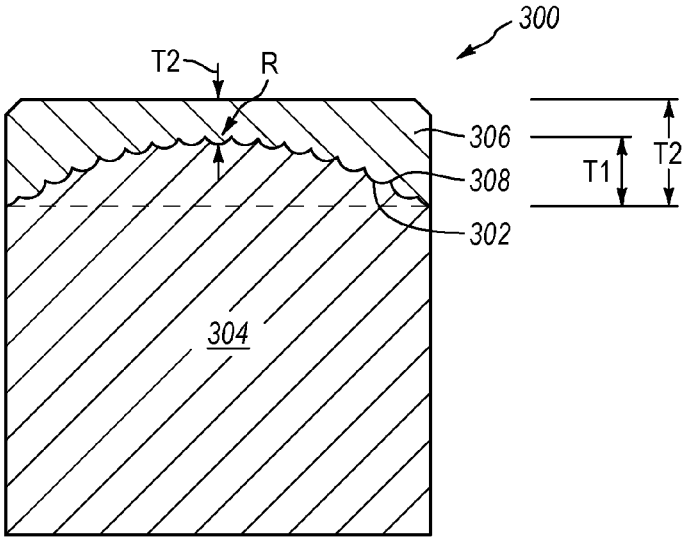
FIG. 3A is a cross-sectional view of a PDC including a substrate having a convexly-curved interfacial surface with a plurality of grooves formed therein according to another embodiment.
Figure 3B:
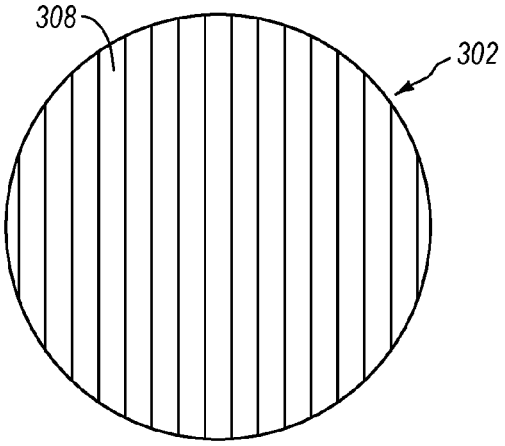
FIG. 3B is a plan view of the convexly-curved interfacial surface of the substrate shown in FIG. 3A.

FIG. 3A is a cross-sectional view of a PDC 300 according to an embodiment and FIG. 3B is a top plan view of a convexly-curved interfacial surface 302 of a substrate 304 to which a PCD table 306 of the PDC 300 is bonded. As discussed above, the PCD table 306 may be a preformed PCD table or may be integrally formed with the substrate 304. The convexly-curved interfacial surface 302 includes a plurality of transversely-extending grooves 308 that are spaced from each other. For example, the grooves 308 may be substantially parallel with each other and exhibit any suitable cross-sectional geometry. The roughened surface structure of the convexly-curved interfacial surface 302 from the grooves 308 may help promote a relatively strong bond between the PCD table 306 and the substrate 304. The PCD table 306 may be leached to any of the leach depths disclosed herein to form a leached region similar to the leached region 122 shown in FIG. 2, and the PCD table 306 and the substrate 304 may exhibit any of the geometric characteristics discussed above regarding the PDC 100, such as R, T1, T2, T3, and D.

Figure 4A:
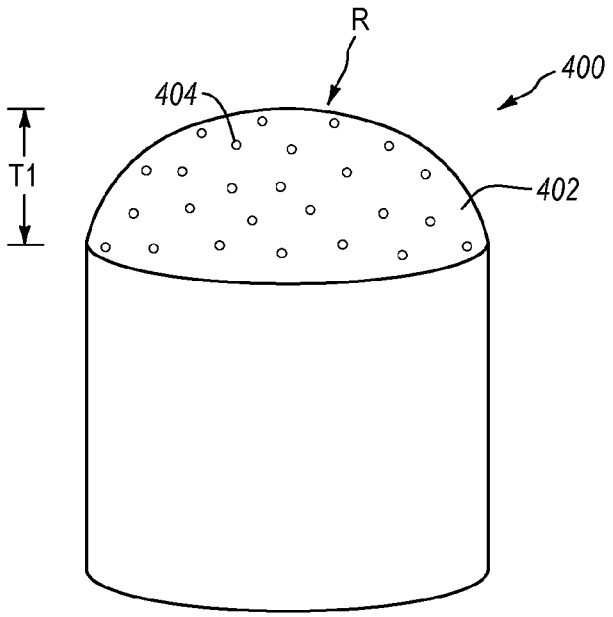
FIG. 4A is an isometric view of a substrate including a convexly-curved interfacial surface having a plurality of recesses formed therein according to another embodiment.
Figure 4B:
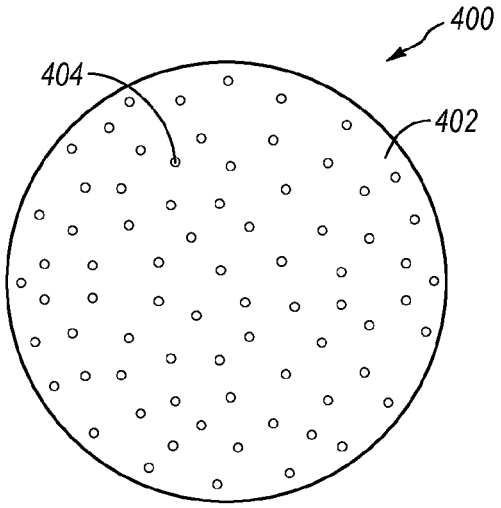
FIG. 4B is a plan view of the convexly-curved interfacial surface shown in FIG. 4A.

FIG. 4A is an isometric view of an embodiment of a substrate 400 including a convexly-curved interfacial surface 402 having a plurality of recesses 404 formed therein according to another embodiment to which a PCD table (not shown) can be bonded and FIG. 4B is a plan view of the convexly-curved interfacial surface 402. The recesses 404 may be spaced apart to form a roughened surface structure that may help promote a relatively strong bond between a PCD table (not shown) and the convexly-curved interfacial surface 402 of the substrate 402. For example, the recesses 404 may be dimples, cylindrical blind holes, or any other type of suitable recess. The PCD table (not shown) may be leached to any of the leach depths disclosed herein to form a leached region similar to the leached region 122 shown in FIG. 2, and the PCD table and the substrate 400 may exhibit any of the geometric characteristics discussed above regarding the PDC 100, such as R, T1, T2, T3, and D.

Figure 5A:
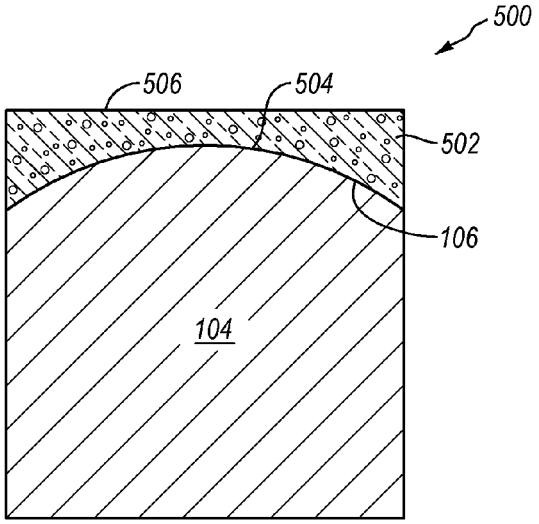
FIGS. 5A and 5B are cross-sectional views at different stages during the fabrication of the PDC shown in FIGS. 1A-1C according to an embodiment of a method.
Figure 5B:
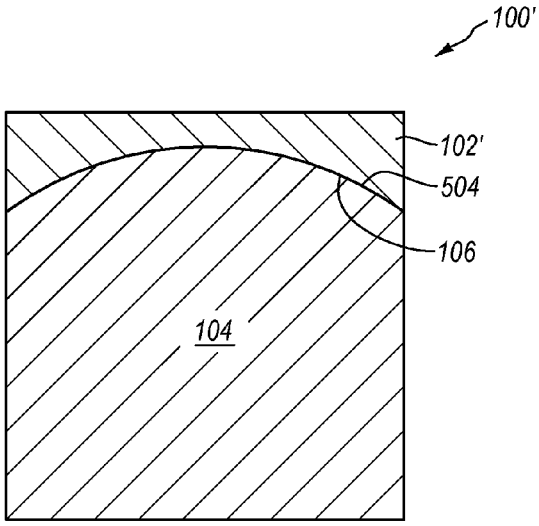

FIGS. 5A and 5B are cross-sectional views at different stages during the fabrication of the PDC 100 shown in FIGS. 1A-1C according to an embodiment of a method. Referring to FIG. 5A, an assembly 500 may be formed by disposing an at least partially leached PCD table 502 having a concavely-curved interfacial surface 504 adjacent to the convexly-curved interfacial surface 106 of the substrate 104. In an embodiment, the at least partially leached PCD table 502 may be formed by leaching a sintered PCD body to form a network of porous, interstitial regions that enables fluid to flow from any exterior surface thereof to another. The concavely-curved interfacial surface 504 of the at least partially leached PCD table 502 is curved to substantially correspond to the convexly-curved interfacial surface 106 of the substrate 104.

In an embodiment, the at least partially leached PCD table 502 may be formed by disposing a plurality of diamond particles on the convexly-curved interfacial surface 106 of one of the substrates 104 to form an assembly and subjecting the assembly to an HPHT process to sintering the diamond particles to form a PCD table that bonds to the convexly-curved interfacial surface 106. Such as a precursor PDC will be geometrically similar to the PDC 100 shown in FIGS. 1A-1C.

The plurality of diamond particles may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes), without limitation. It should be noted that the as-sintered average diamond grain size may be substantially the same or different than that of the precursor diamond particles used.

In some embodiments, non-diamond carbon, such as graphite particles, fullerenes, other non-diamond $sp^2$-type carbon, or combinations of the foregoing may be mixed with the plurality of diamond particles. The non-diamond carbon substantially converts to diamond during the HPHT fabrication process discussed in more detail below. The presence of the non-diamond carbon during the fabrication of the PCD table is believed to enhance the diamond density of the PCD table so formed. The non-diamond carbon may be selected to be present in a mixture with the plurality of diamond particles in an amount of about 0.1 weight % ("wt %") to about 20 wt %, such as about 0.1 wt % to about 10 wt %, about 1 wt % to about 9 wt %, about 2 wt % to about 9 wt %, about 3 wt % to about 6 wt %, about 4.5 wt % to about 5.5 wt %, about 5 wt %, about 0.1 wt % to about 0.8 wt %, or about 0.1 wt % to about 0.50 wt %.

The graphite particles employed for the non-diamond carbon may exhibit, for example, an average particle size of about 1 μm to about 5 μm (e.g., about 1 μm to about 3 μm) so that the graphite particles may fit into interstitial regions defined by the plurality of diamond particles. According to various embodiments, the graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa.

The assembly of the diamond particles and the substrate 104 may be placed in a pressure transmitting medium, such as a refractory metal can embedded in pyrophyllite or other pressure transmitting medium. The pressure transmitting medium, including the assembly of the diamond particles and substrate 104 enclosed therein, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table. For example, the pressure of the HPHT process may be about 8 GPa to about 10 GPa and the temperature of the HPHT process may be about 1150° C. to about 1450° C. (e.g., about 1200° C. to about 1400° C.). Upon cooling from the HPHT process, the PCD table so formed becomes bonded (e.g., metallurgically) to the substrate 104 to form a precursor PDC. Of course, in some embodiments, the precursor PDC may be used as the final product and it may be subjected to finish process, such as at least one of chamfering, lapping, or leaching as disclosed herein. In such embodiments, the PCD table is considered integrally formed with the substrate 104. The foregoing pressure values employed in the HPHT process refer to the cell pressure in the pressure transmitting medium that transfers the pressure from the ultra-high pressure press to the assembly.

During the HPHT process, metal-solvent catalyst from the substrate 104 or another source may be liquefied and may infiltrate into the diamond particles. The infiltrated metal-solvent catalyst functions as a catalyst that catalyzes formation of directly bonded-together diamond grains from the diamond particles to form the PCD table. The PCD table so formed is comprised of a plurality of directly bonded-together diamond grains exhibiting diamond-to-diamond bonding, with the metal-solvent catalyst disposed interstitially between the bonded diamond grains.

When the HPHT sintering pressure is greater than about 7.5 GPa cell pressure, optionally in combination with the average diamond particle size being less than 30 μm, the PCD table (prior to being leached) defined collectively by the bonded diamond grains and the metal-solvent catalyst may exhibit a coercivity of about 115 Oe or more and a metal-solvent catalyst content of less than about 7.5% by weight as indicated by a specific magnetic saturation of about 15 G~cm$^3$/g or less. In another embodiment, the coercivity may be about 115 Oe to about 250 Oe and the specific magnetic saturation of the PCD table (prior to being leached) may be greater than 0 G~cm$^3$/g to about 15 G~cm$^3$/g. In another embodiment, the coercivity may be about 115 Oe to about 175 Oe and the specific magnetic saturation of the PCD may be about 5 G·cm$^3$/g to about 15 G·cm$^3$/g. In yet another embodiment, the coercivity of the PCD table (prior to being leached) may be about 155 Oe to about 175 Oe and the specific magnetic saturation of the first region 114 may be about 10 G·cm$^3$/g to about 15 G·cm$^3$/g. The specific permeability (i.e., the ratio of specific magnetic saturation to coercivity) of the PCD may be about 0.10 G·cm$^3$/g·Oe or less, such as about 0.060 G·cm$^3$/g·Oe to about 0.090 G·cm$^3$/g·Oe. In some embodiments, the average grain size of the bonded diamond grains may be less than about 30 μm and the metal-solvent catalyst content in the PCD table (prior to being leached) may be less than about 7.5% by weight (e.g., about 1% to about 6% by weight, about 3% to about 6% by weight, or about 1% to about 3% by weight). Additional details about the magnetic properties of PCD tables formed at a cell pressure greater than about 7.5 GPa and magnetic testing techniques can be found in U.S. Pat. No. 7,866,418, which is incorporated herein, in its entirety, by this reference.

After formation of the precursor PDC, the substrate 104 may be ground away leaving a dome/plug of the substrate 104 within the PCD table so formed. The PCD table with this dome/plug of the substrate 104 may be subjected to a leaching process effective to substantially remove all of the metal-solvent catalyst from the PCD table and the dome/plug to form the at least partially leached PCD table 502. For example, the acid may be aqua regia, nitric acid, hydrofluoric acid, or combinations thereof. In another embodiment, the concavely-curved interfacial surface 504 of the at least partially leached PCD table 502 may be defined by HPH sintering the diamond particles with a sacrificial material and mixing the diamond particles with a metal-solvent catalyst. For example, the sacrificial material may include refractory metal carbides, hexagonal boron nitride, or combinations thereof that may be removed after forming the PCD table via leaching.

Referring again to FIG. 5A, the assembly 500 may be subjected to an HPHT process using any of the HPHT conditions disclosed herein to infiltrate the at least partially leached PCD table 502 with a metallic infiltrant from the substrate 104 or other source. For example, the pressure of the HPHT process may be about 5 GPa to about 7 GPa and the temperature of the HPHT process may be about 1150° C. to about 1450° C. (e.g., about 1200° C. to about 1400° C.). In an embodiment, the cell pressure of the HPHT process used to attach the at least partially leached PCD table 502 may be less than the cell pressure of the HPHT process used to form the at least partially leached PCD table 502. FIG. 5B illustrates a precursor PDC 100' including a PCD table 102' so formed that may be at least partially infiltrated with the metallic infiltrant and bonded to the substrate 104 upon cooling from the HPHT process. The depth to which the at least partially leached PCD table 502 is infiltrated may be controlled by controlling the pressure and temperature of the HPHT process used in the infiltration process. The infiltration may substantially complete to an upper surface 506 or may be only partial to an intermediate depth within the at least partially leached PCD table. Additional details about controlling infiltration that may be used to practice embodiments of the invention are disclosed in U.S. application Ser. No. 12/961,787, the disclosure of which is incorporated herein, in its entirety, by this reference.

After forming the precursor PDC 100', the PCD table 102' and/or substrate 104 may be subjected to various material removal processes to form the PDC 100. For example, PCD table 102' may be planarized to form the upper surface 106 (FIGS. 1A-1C) and ground to define the chamfer 113 (FIGS. 1A-1C). If desired, the PCD table 102 so formed may be leached as previously discussed. Of course, the at least partially leached PCD table 502 may be pre-chamfered prior to infiltration in some embodiments.

Figure 5C:
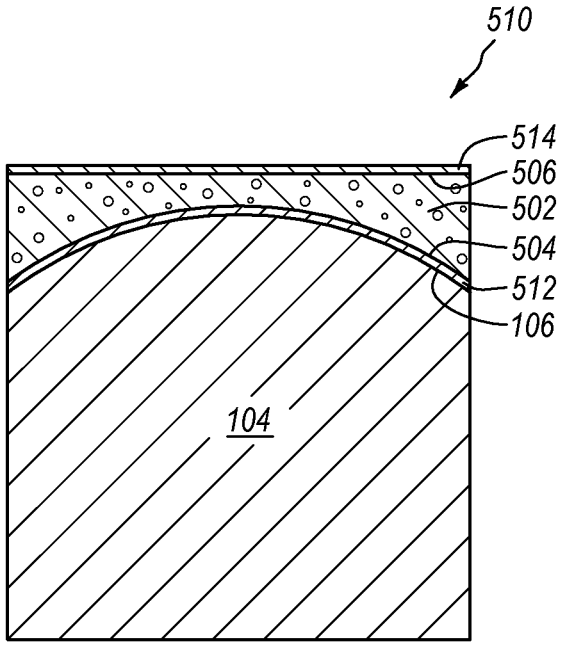
FIG. 5C is a cross-sectional view of an assembly to be HPHT processed in which an at least partially leached PCD table is infiltrated from both sides thereof with different infiltrants according to an embodiment of a method.

FIG. 5C is a cross-sectional view of an assembly 510 to be HPHT processed in which an at least partially leached PCD table 502 is infiltrated from both sides thereof with different infiltrants according to an embodiment of a method. Such an embodiment may better facilitate infiltration of the porous, at least partially leached PCD 502 when the at least partially leached PCD table 502 is formed at a cell pressure greater than about 7.5 GPa and has relatively small interstitial region pore volume. The assembly 510 includes a first infiltrant 512 disposed between the at least partially leached PCD table 502 and the substrate 104. The first infiltrant 512 may be in the form of a foil, powder, paste, or disc that is shaped to generally correspond to the concavely-curved interfacial surface 504 of the at least partially leached PCD table 502 and the convexly-curved interfacial surface 106 of the substrate 104. A second infiltrant 514 is disposed adjacent to the upper surface 506 of the at least partially leached PCD table 502 such that the at least partially leached PCD table 502 is disposed between the first infiltrant 512 and the second infiltrant 514.

The first and second infiltrants 512 and 514 may be formed from a variety of different metals and alloys. For example, the first infiltrant 512 may be formed from a nickel-silicon alloy, a nickel-silicon-boron alloy, a cobalt-silicon alloy, cobalt-silicon-boron alloy, or combinations thereof. Examples of nickel-silicon alloys, nickel-silicon-boron alloys, cobalt-silicon alloys, and cobalt-silicon-boron alloys that may be used for the first infiltrant 512 are disclosed in U.S. patent application Ser. No. 13/795,027 filed on 12 Mar. 2013, the disclosure of which is incorporated herein, in its entirety, by this reference.

The second infiltrant 514 may have a melting temperature or liquidus temperature at standard pressure of less than about 1300° C. The second infiltrant may also be more readily removed (e.g., leached) from the PCD table than a pure cobalt or pure nickel infiltrant, or cobalt provided from a cobalt-cemented tungsten carbide substrate. Examples of metals and alloys for the second infiltrant 514 that facilitate faster, more complete leaching include, but are not limited to copper, tin, germanium, gadolinium, magnesium, lithium, silver, zinc, gallium, antimony, bismuth, cupro-nickel, mixtures thereof, alloys thereof, and combinations thereof. Examples of metal and alloys that may be used for the second infiltrant 514 are disclosed in U.S. patent application Ser. No. 13/795,027.

The assembly 510 may be subjected to any of the HPHT process conditions disclosed herein during which the first infiltrant 514 liquefies and infiltrants into the at least partially leached PCD table 502 along with the second infiltrant 516. Depending on the volume of the porosity in the at least partially leached PCD table 502 and the volumes of the first and second infiltrants 512 and 514, a metallic infiltrant from the substrate 104 (e.g., cobalt from a cobalt-cemented tungsten carbide substrate) may also infiltrate into the at least partially leached PCD table 502 following infiltration of the first infiltrant 512. At least some of the interstitial regions of the infiltrated at least partially leached PCD table 502 may be occupied by an alloy that is a combination of the first infiltrant 512, second infiltrant 514, and (if present) the metallic infiltrant from the substrate 104. Such an alloy may have a composition that varies depending throughout a thickness of the infiltrated at least partially leached PCD table 502, and examples of which are disclosed in U.S. patent application Ser. No. 13/795,027. For example, the alloy may include at least one of nickel or cobalt; at least one of carbon, silicon, boron, phosphorus, cerium, tantalum, titanium, niobium, molybdenum, antimony, tin, or carbides thereof; and at least one of magnesium, lithium, tin, silver, copper, nickel, zinc, germanium, gallium, antimony, bismuth, or gadolinium Upon cooling from the HPHT process, the infiltrated at least partially leached PCD table 502 attaches to the convexly-curved interfacial surface 106 of the substrate 104. After attaching the infiltrated at least partially leached PCD table 502 to the substrate 104, the infiltrated at least partially leached PCD table 502 may be shaped (e.g., chamfering) and/or leached as disclosed in any of the embodiments disclosed herein (e.g., as shown and/or described with reference to FIG. 2). Of course, the at least partially leached PCD table 502 may be pre-chamfered prior to infiltration in some embodiments.

It should be noted that in any of the embodiments of methods disclosed herein, other types of substrates besides the substrate 104 may be used in both the formation of the at least partially leached PCD table 502 and in the assembly of a substrate with the at least partially leached PCD table 502. For example, the substrate 304 or 400 may be employed instead of the substrate 104.

Figure 6:
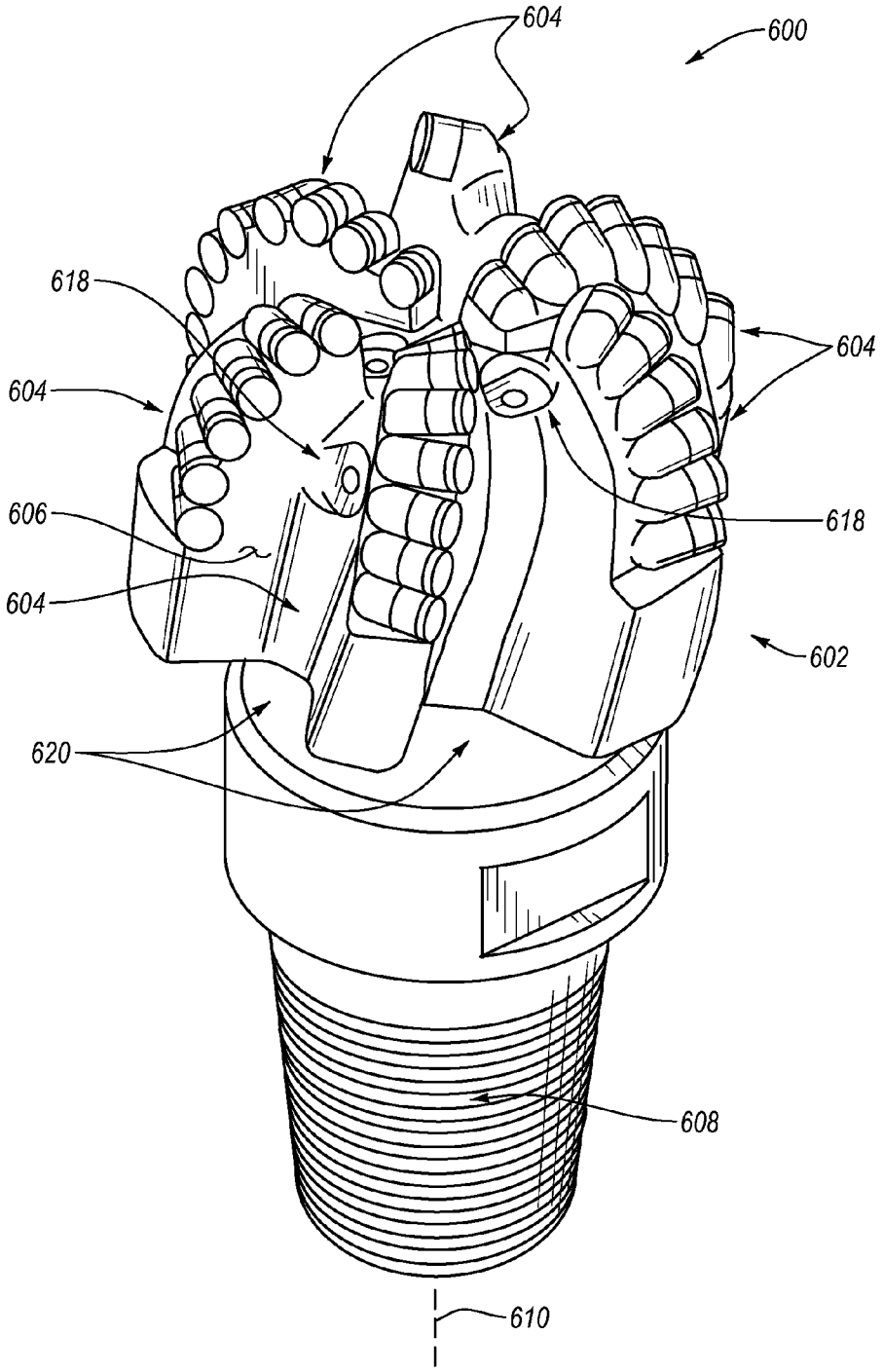
FIG. 6 is an isometric view of an embodiment of a rotary drill bit that may employ one or more of the disclosed PDC embodiments.
Figure 7:
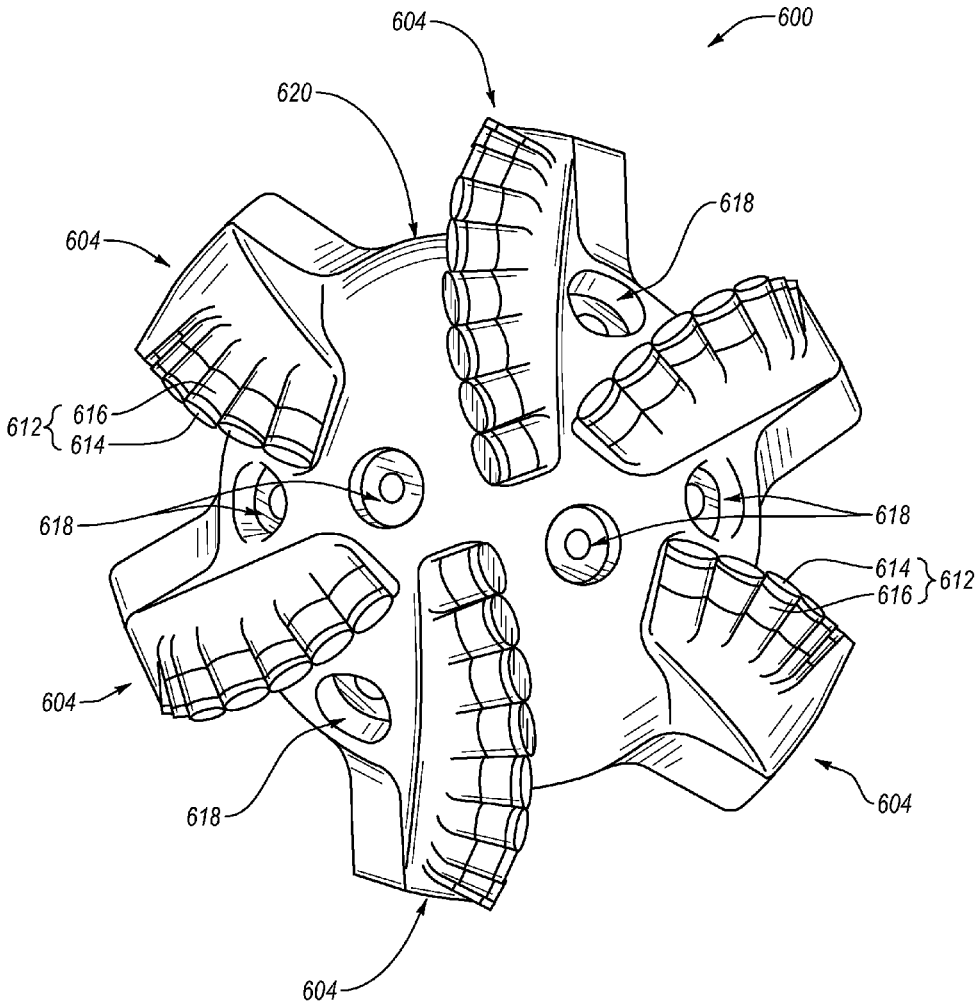
FIG. 7 is a top elevation view of the rotary drill bit shown in FIG. 6.

FIG. 6 is an isometric view and FIG. 7 is a top elevation view of an embodiment of a rotary drill bit 600 that includes at least one PDC configured according to any of the disclosed PDC embodiments. The rotary drill bit 600 comprises a bit body 602 that includes radially and longitudinally extending blades 604 having leading faces 606, and a threaded pin connection 608 for connecting the bit body 602 to a drilling string. The bit body 602 defines a leading end structure for drilling into a subterranean formation by rotation about a longitudinal axis 610 and application of weight-on-bit. At least one PDC, configured according to any of the disclosed PDC embodiments, may be affixed to the bit body 602. With reference to FIG. 7, each of a plurality of PDCs 612 is secured to the blades 604 of the bit body 602 (FIG. 6). For example, each PDC 612 may include a PCD table 614 bonded to a substrate 616. More generally, the PDCs 612 may comprise any PDC disclosed herein, without limitation. In addition, if desired, in some embodiments, a number of the PDCs 612 may be conventional in construction. Also, circumferentially adjacent blades 604 define so-called junk slots 620 therebetween. Additionally, the rotary drill bit 600 includes a plurality of nozzle cavities 618 for communicating drilling fluid from the interior of the rotary drill bit 600 to the PDCs 612.

FIGS. 6 and 7 merely depict one embodiment of a rotary drill bit that employs at least one PDC fabricated and structured in accordance with the disclosed embodiments, without limitation. The rotary drill bit 700 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIGS. 1A-1C) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIGS. 1A-1C) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

The following working examples provide further detail in connection with the specific PDC embodiments described above. Specifically, comparative working examples 1 and 2 were compared to working example 1 of the invention.

Comparative Working Example 1

PDCs were formed according to the following process. A layer of diamond particles having an average particle size of about 19 μm was placed adjacent to a substantially planar interfacial surface of a cobalt-cemented tungsten carbide substrate. The diamond particles and the cobalt-cemented tungsten carbide substrate were positioned within a pyrophyllite cube, and HPHT processed at a temperature of about 1400° C. and a cell pressure of about 7.0-7.7 GPa in a high-pressure cubic press to sinter the diamond particles and attach the resulting PCD table to the cobalt-cemented tungsten carbide substrate.

Comparative Working Example 2

PDCs were formed according to the following process. A layer of diamond particles having an average particle size of about 19 μm was placed adjacent to a substantially planar interfacial surface of a first cobalt-cemented tungsten carbide substrate. The diamond particles and the first cobalt-cemented tungsten carbide substrate were positioned within a pyrophyllite cube, and HPHT processed at a temperature of about 1400° C. and a cell pressure of about 7.0-7.7 GPa in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between the diamond grains within the PCD table.

The at least partially leached PCD table was then placed adjacent to a second cobalt-cemented tungsten carbide substrate. Both the at least partially leached PCD table and the second cobalt-cemented tungsten carbide substrate had substantially planar interfacial surfaces that mated with each other. The at least partially leached PCD table and the second cobalt-cemented tungsten carbide substrate were positioned within a pyrophyllite cube, and HPHT processed at a temperature of about 1400° C. and a cell pressure of about 5 GPa in a high-pressure cubic press to attach the at least partially leached PCD table to the second cobalt-cemented tungsten carbide substrate and infiltrate the at least partially leached PCD table with cobalt from the second cobalt-cemented tungsten carbide substrate.

Working Example 1

PDCs configured according to the PDC 100 shown in FIGS. 1A-1C were formed according to the following process. A layer of diamond particles having an average particle size of about 19 μm was placed adjacent to a convexly-curved interfacial surface of a first cobalt-cemented tungsten carbide substrate configured as the substrate 104 shown in FIGS. 1A-1C, with R being about 0.783 inch, T1 being about 0.040 inch, and a diameter of about 0.625 inch. The diamond particles and the first cobalt-cemented tungsten carbide substrate were positioned within a pyrophyllite cube, and HPHT processed at a temperature of about 1400° C. and a cell pressure of about 7.0-7.7 GPa in a high-pressure cubic press to sinter the diamond particles and attach the resulting PCD table to the first cobalt-cemented tungsten carbide substrate. The PCD table had a maximum thickness T3 (see FIG. 1C) of about 0.090 inch and a minimum thickness of about 0.050 inch. The PCD table was then separated from the first cobalt-cemented tungsten carbide substrate by grinding away the first cemented tungsten carbide substrate to the PCD table. The PCD table and the dome/plug of the first cobalt-cemented tungsten carbide substrate remaining in the PCD table was subsequently leached to remove substantially all of the cobalt from the interstitial regions between the diamond grains within the PCD table and the dome/plug from the PCD table.

The at least partially leached PCD table was then placed adjacent to a second cobalt-cemented tungsten carbide substrate such that a convexly-curved interfacial surface of the second cobalt-cemented tungsten carbide substrate mated with a concavely-curved interfacial surface of the at least partially leached PCD table as shown in FIG. 5A. The at least partially leached PCD table and the second cemented tungsten carbide substrate were positioned within a cell assembly, and HPHT processed at a temperature of about 1400° C. and a cell pressure of about 5 GPa in a high-pressure cubic press to attach the at least partially leached PCD table to the second cemented tungsten carbide substrate and infiltrate the at least partially leached PCD table with cobalt from the second cemented tungsten carbide substrate.

Impact Resistance Test Results

The PDCs from comparative working examples 1 and 2 and working example 1 of the invention were subjected to impact testing to evaluate their impact resistance. In the impact test on each PDC, a weight was vertically dropped on a sharp, non-chamfered edge of a PCD table of a PDC to impact the edge with 40 J of energy. The tested PDC was oriented at about a 15 degree back rake angle. The test was repeated until the tested PDC failed. The PDC was considered to have failed when about 30% of the PCD table has spalled and/or fractured. The weight was a flat circular plate made from a heat treated S7 tool steel having a diameter of about 2.5 inches and a thickness of about 0.500 inches and a hardness of Rc 55±1. The weight was rotated after each impact to ensure that a fresh undamaged portion of the weight was used for the next impact against the PCD table.

Figure 8:
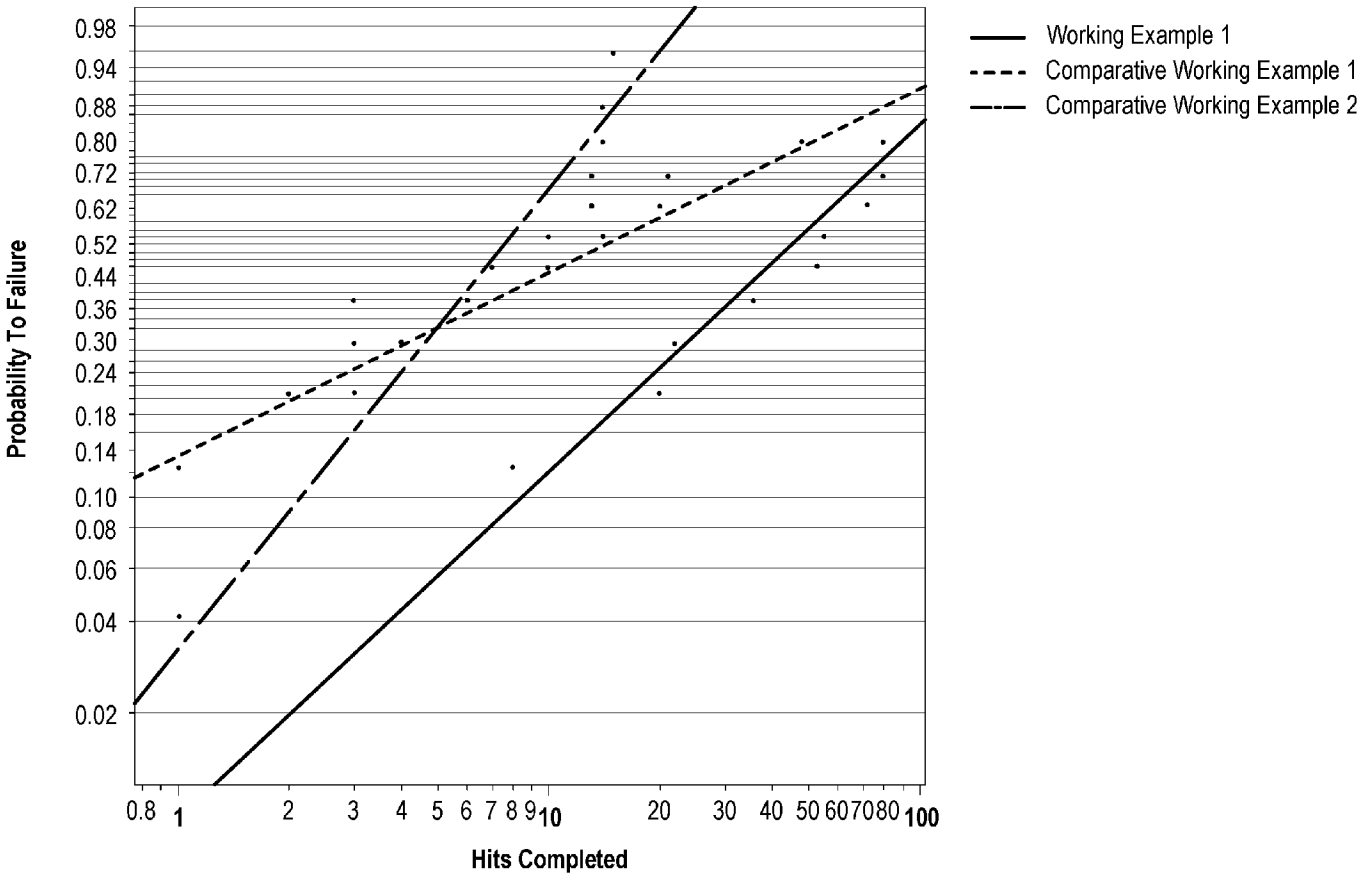
FIG. 8 is a probability to failure for tested PDCs versus number of hits to failure for the impact tests on comparative working examples 1 and 2 and working example 1 of the invention.

FIG. 8 is a probability to failure for tested PDCs versus number of hits to failure for the impact tests on comparative working examples 1 and 2 and working example 1 of the invention. Each data point represents a failed PDC. As shown in FIG. 8, for a given number of hits by the impact test weight, working example 1 of the invention had a significantly lower probability of failure than comparative working examples 1 and 2, indicating that the convexly-curved interfacial surface of the substrate of the PDCs of working example 1 of the invention improved impact resistance relative to a planar interface. For example, at a 50% probability of failure for a given number of PDCs, working example 1 of the invention survived about 43 hits, comparative working example 1 survived about 13 hits, and comparative working example 2 survived about 7 hits.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A polycrystalline diamond compact, comprising:

a substrate including at least one side surface and a convexly-curved interfacial surface, the convexly-curved interfacial surface extending inwardly directly from the at least one side surface of the substrate; and a polycrystalline diamond table bonded to the convexly-curved interfacial surface of the substrate, the polycrystalline diamond table including:

a plurality of bonded diamond grains defining a plurality of interstitial regions;

a concavely-curved table interfacial surface substantially corresponding to the convexly-curved interfacial surface of the substrate;

an upper surface that is substantially perpendicular;

at least one lateral surface extending between the concavely-curved table interfacial surface and the upper surface;

a first region adjacent to the substrate that includes a metallic infiltrant disposed interstitially between at least a portion of the plurality of bonded diamond grains thereof;

a second region extending inwardly from the upper surface to a depth therein, the plurality of interstitial regions of the second region being substantially free of the metallic infiltrant; and wherein the polycrystalline diamond table exhibits a ratio of a maximum depth of the second region to a minimum thickness of the polycrystalline diamond table of about 0.30 to about 0.50.

2. The polycrystalline diamond compact of claim 1 wherein the convexly-curved interfacial surface of the substrate exhibits a generally ellipsoidal geometry or generally hemispherical geometry.

3. The polycrystalline diamond compact of claim 1 wherein the convexly-curved interfacial surface of the substrate includes a plurality of grooves extending transversely across the convexly-curved interfacial surface.

4. The polycrystalline diamond compact of claim 3 wherein the plurality of grooves are substantially parallel to each other.

5. The polycrystalline diamond compact of claim 1 wherein the convexly-curved interfacial surface of the substrate includes a plurality of recesses formed therein.

6. The polycrystalline diamond compact of claim 1 wherein the polycrystalline diamond table exhibits a minimum thickness over an uppermost location of the convexly-curved interfacial surface of about 0.0050 inch or more, and the uppermost location is generally centrally located on the polycrystalline diamond table.

7. The polycrystalline diamond compact of claim 1 wherein the metallic infiltrant includes cobalt, iron, nickel, or alloys thereof.

8. The polycrystalline diamond compact of claim 1 wherein the second region is at least partially leached of the metallic infiltrant and exhibits a maximum leach depth that is greater than about 250 μm as measured from the upper surface.

9. The polycrystalline diamond compact of claim 1 wherein the convexly-curved interfacial surface of the substrate exhibits a radius of curvature of about 0.50 inch to about 1.20 inch.

10. A polycrystalline diamond compact, comprising:

a substrate including at least one side surface and a convexly-curved interfacial surface extending inwardly directly from the at least one side surface; and a polycrystalline diamond table bonded to the convexly-curved interfacial surface at a concavely-curved table interfacial surface substantially corresponding to the convexly-curved interfacial surface, the preformed polycrystalline diamond table including an upper surface generally opposite the table interfacial surface, wherein the upper surface is substantially planar; and wherein the polycrystalline diamond table exhibits about 30 hits to about 80 hits to failure at about a 50% probability of failure in a 40 J repeating impact test;

wherein the polycrystalline dia1nond table exhibits a maximum thickness of 0.050 inch to about 0.150 inch;

wherein the polycrystalline diamond table exhibits a minimum thickness of 0.0050 inch to about 0.100 inch.

11. The polycrystalline diamond compact of claim 10 wherein the polycrystalline diamond table exhibits about 45 hits to about 55 hits to failure in the repeating impact test.

12. The polycrystalline diamond compact of claim 10 wherein the polycrystalline diamond table exhibits an average diamond grain size of about 18 μm to about 25 μm.

13. The polycrystalline diamond compact of claim 10 wherein the convexly-curved interfacial surface extends inwardly directly from the at least one side surface of the substrate to define at least one peripheral edge between the at least one side surface and the convexly-curved interfacial surface.

14. The polycrystalline diamond compact of claim 10 wherein the convexly-curved interfacial surface of the substrate exhibits a generally elliptical or generally hemispherical geometry.

15. The polycrystalline diamond compact of claim 10 wherein the polycrystalline diamond table is at least partially leached.

16. A rotary drill bit, comprising:

a bit body configured to engage a subterranean formation; and a plurality of polycrystalline diamond cutting elements affixed to the bit body, at least one of the plurality of polycrystalline diamond cutting elements including:

a substrate including at least one side surface and a convexly-curved interfacial surface, the convexly-curved interfacial surface extending inwardly directly from the at least one side surface of the substrate; and a polycrystalline diamond table bonded to the convexly-curved interfacial surface at a concavely-curved table interfacial surface substantially corresponding to the convexly-curved interfacial surface, the polycrystalline diamond table including an upper surface generally opposite the concavely-curved table interfacial surface, wherein the upper surface is substantially planar;

wherein the polycrystalline diamond table exhibits a maximum thickness of 0.050 inch to about 0.150 inch;

wherein the polycrystalline diamond table exhibits a minimum thickness of 0.0050 inch to about 0.100 inch;

wherein the at least one of the plurality of polycrystalline diamond cutting elements exhibits about 30 hits to about 80 hits to failure at about a 50% probability of failure in a 40 J repeating impact test.

* * * * *